US005606154A

United States Patent [19]

Doigan et al.

[11] Patent Number: 5,606,154

[45] Date of Patent: Feb. 25, 1997

[54] TIMED ADVERTISING IN ELEVATORS AND OTHER SHUTTLES

[75] Inventors: Lloyd D. Doigan, West Bloomfield, Mich.; Randy G. Henley, Danbury, Conn.

[73] Assignee: Otis Elevator Company, Farmington, Conn.

[21] Appl. No.: 372,625

[22] Filed: Jan. 13, 1995

[51] Int. Cl.[6] ..... B66B 3/00

[52] U.S. Cl. ..... 187/396; 187/393

[58] Field of Search ..... 187/392, 396, 187/391, 397

[56] References Cited

U.S. PATENT DOCUMENTS

| | | | |
|---|---|---|---|
| 4,749,062 | 6/1988 | Tsuji et al. | 187/139 |
| 4,852,696 | 8/1989 | Fukuda et al. | 187/139 |
| 4,995,479 | 2/1991 | Fujiwara et al. | 187/135 |
| 5,485,897 | 1/1996 | Matsumoto et al. | 187/399 |

FOREIGN PATENT DOCUMENTS

| | | | |
|---|---|---|---|
| 403232 | 6/1995 | European Pat. Off. | 187/396 |
| 4-256672 | 9/1992 | Japan | 187/396 |
| 5-319715 | 12/1993 | Japan | 187/396 |
| 2089526 | 6/1982 | United Kingdom | 187/396 |
| 2276289 | 9/1994 | United Kingdom | B66B 3/00 |

OTHER PUBLICATIONS

John Kerns and Edward Baker, Abstract from STN, file PATOSWO, document No. 91:161878 May 22, 1992.

Translation of Japanese Patetn publication 4–256672 Feb. 7, 1992.

*Primary Examiner*—Robert Nappi

[57] ABSTRACT

One or more messages, such as an ad, is selected and played to potential passengers at a shuttle landing, such as an elevator corridor, waiting for a car to respond to a call, the ad being selected to play completely within the time estimated for the car to respond to the call. In an elevator or other shuttle car, one or more ads are selected having a playing time less than the time it takes to reach the next scheduled landing stop. Ads are arranged in groups of ranges of playing times or are selected in series until the time is exhausted, or both. The car load and the identification of the ads (if they are completed) are recorded for billing purposes. Ads are prevented from playing while passengers enter and exit the cars (except for passengers traveling in the opposite direction from those whose call started the playing of an ad). Other criteria such as time of day, day of week, load in the car, and landing (floor) of the system can be used to limit ad selection. A background program may be played when ads are not playing, if desired.

26 Claims, 6 Drawing Sheets

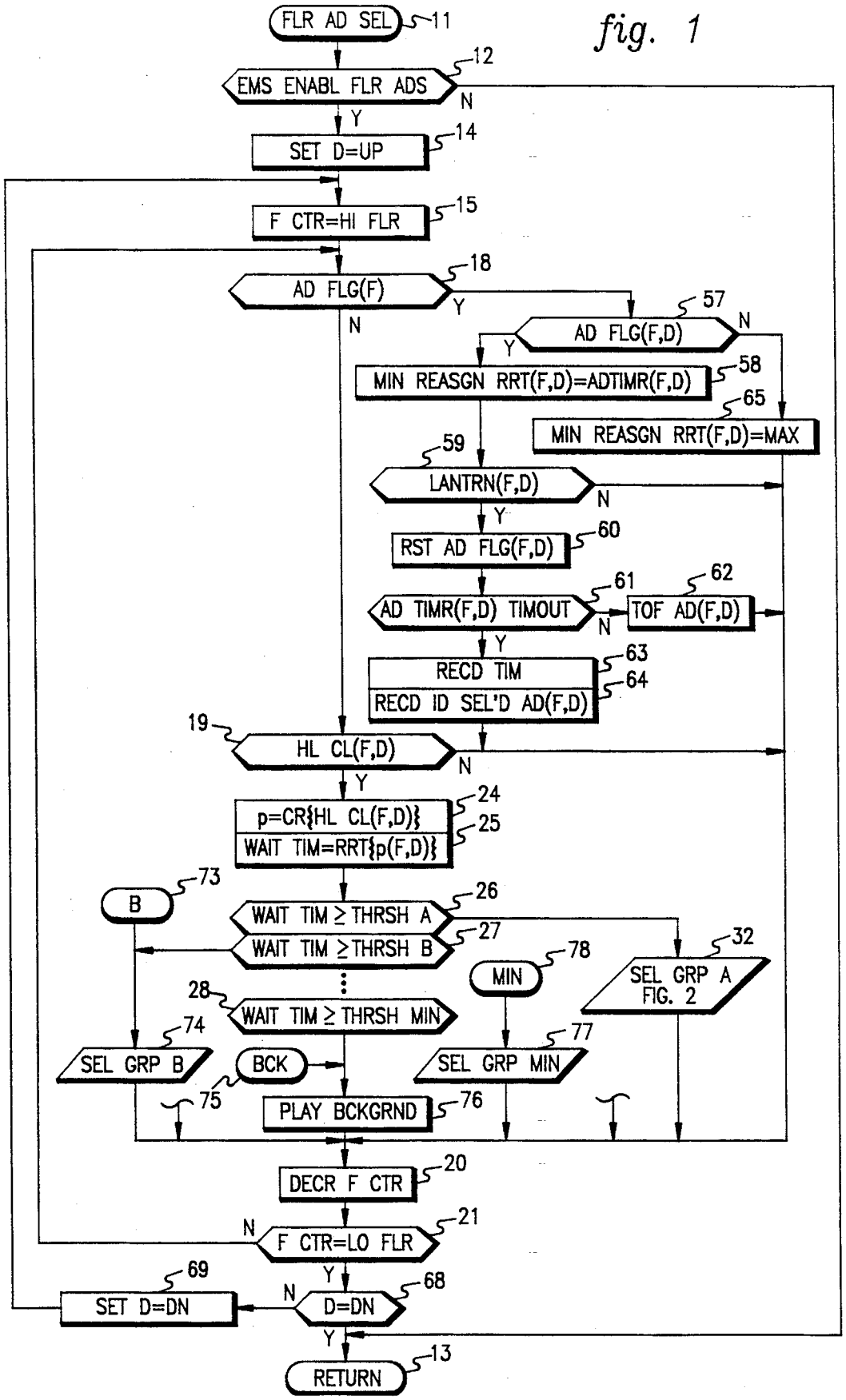
fig. 1
FLR AD SEL
11
EMS ENABL FLR ADS
12
N
Y
SET D=UP
14
F CTR=HI FLR
15
AD FLG(F)
18
Y
N
AD FLG(F,D)
57
Y
N
MIN REASGN RRT(F,D)=ADTIMR(F,D)
58
MIN REASGN RRT(F,D)=MAX
65
LANTRN(F,D)
59
N
Y
RST AD FLG(F,D)
60
AD TIMR(F,D) TIMOUT
61
TOF AD(F,D)
62
N
Y
RECD TIM
63
RECD ID SEL'D AD(F,D)
64
HL CL(F,D)
19
N
Y
p=CR{HL CL(F,D)}
24
WAIT TIM=RRT{p(F,D)}
25
B
73
WAIT TIM ≥ THRSH A
26
WAIT TIM ≥ THRSH B
27
MIN
78
SEL GRP A
FIG. 2
32
WAIT TIM ≥ THRSH MIN
28
SEL GRP B
74
BCK
75
SEL GRP MIN
77
PLAY BCKGRND
76
DECR F CTR
20
N
F CTR=LO FLR
21
Y
SET D=DN
69
N
D=DN
68
Y
RETURN
13

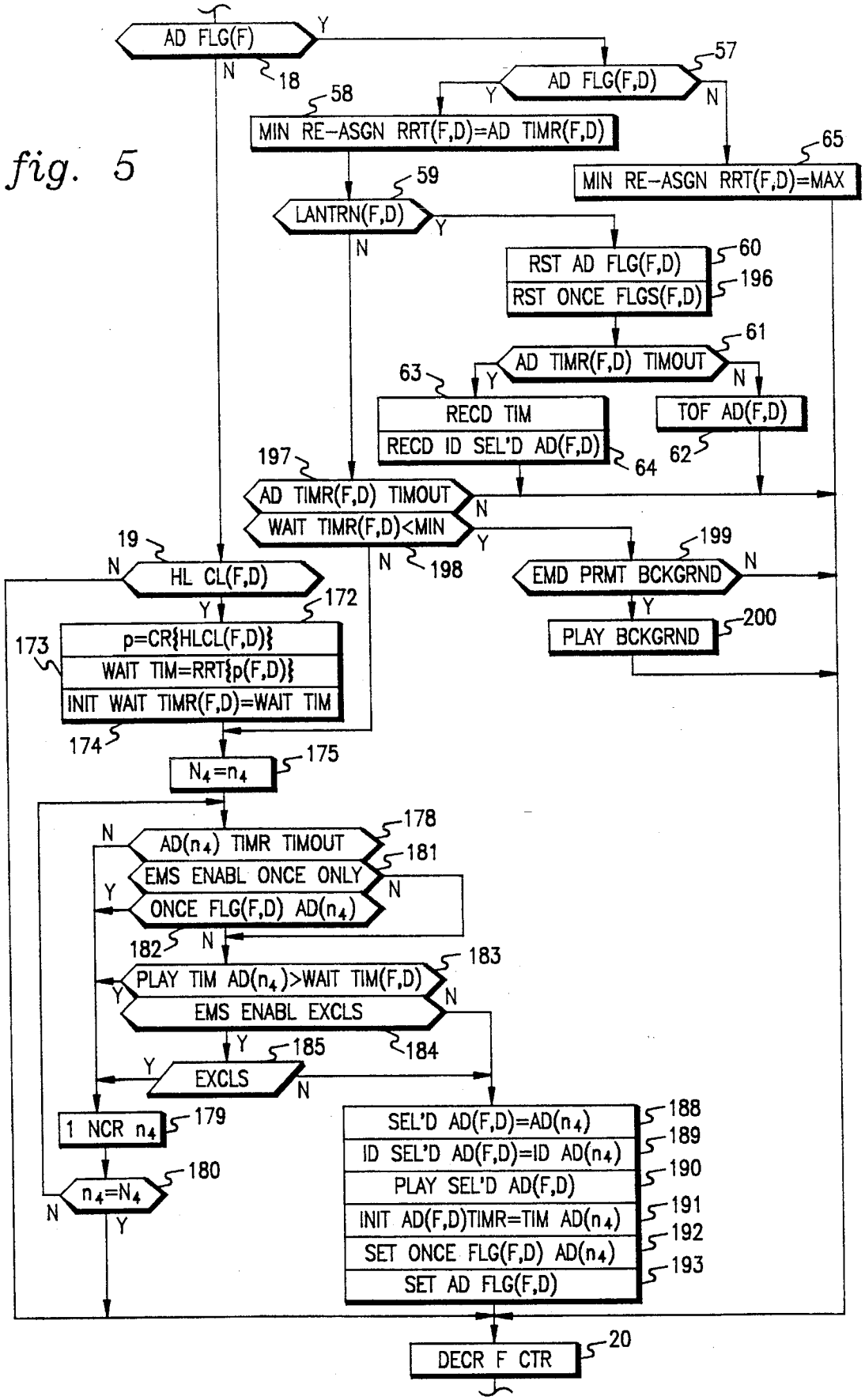
fig. 5
AD FLG(F)
Y
N
18
AD FLG(F,D)
57
Y
N
58
MIN RE-ASGN RRT(F,D)=AD TIMR(F,D)
65
MIN RE-ASGN RRT(F,D)=MAX
59
LANTRN(F,D)
Y
N
RST AD FLG(F,D)
60
RST ONCE FLGS(F,D)
196
61
AD TIMR(F,D) TIMOUT
63
Y
N
RECD TIM
RECD ID SEL'D AD(F,D)
64
TOF AD(F,D)
62
197
AD TIMR(F,D) TIMOUT
N
WAIT TIMR(F,D)<MIN
Y
N
198
199
EMD PRMT BCKGRND
N
Y
PLAY BCKGRND
200
19
N
HL CL(F,D)
Y
172
173
p=CR{HLCL(F,D)}
WAIT TIM=RRT{p(F,D)}
INIT WAIT TIMR(F,D)=WAIT TIM
174
N4=n4
175
178
N
AD(n4) TIMR TIMOUT
181
EMS ENABL ONCE ONLY
Y
N
ONCE FLG(F,D) AD(n4)
182
N
183
PLAY TIM AD(n4)>WAIT TIM(F,D)
Y
N
EMS ENABL EXCLS
Y
185
184
Y
EXCLS
N
1 NCR n4
179
180
n4=N4
N
Y
188
SEL'D AD(F,D)=AD(n4)
189
ID SEL'D AD(F,D)=ID AD(n4)
190
PLAY SEL'D AD(F,D)
191
INIT AD(F,D)TIMR=TIM AD(n4)
192
SET ONCE FLG(F,D) AD(n4)
193
SET AD FLG(F,D)
20
DECR F CTR

TIMED ADVERTISING IN ELEVATORS AND OTHER SHUTTLES

TECHNICAL FIELD

This invention relates to providing advertising or other messages to audiences riding in and waiting for shuttles such as elevator cars (passengers) in a manner to assure advertising value, including (inter alia) selecting ads of a suitable length, avoiding assignment changes that could interrupt the message, and charging only for ads that run completely.

BACKGROUND ART

Elevator cars and elevator floor landings provide a unique opportunity to deliver commercial messages to substantially captive consumers. However, advertisers are likely to be reluctant to advertise in a manner in which their entire message is not likely to be delivered, or to be charged for haphazard, partial delivery of messages, rather than only for delivery of complete messages. Due concern for safety will prevent messages from being played while passengers are entering or exiting a car since the distraction of the message could cause a passenger to collide with elements of the elevator, the sill, or other passengers. Good elevator service dictates that passengers should not be attempted to delay exiting or entering a car due to the their interests in a message which is playing. As used herein, "messages" mean dynamic, audible and/or visual messages, but not print or invariant graphics, but may include a constant video image played contemporaneously with accompanying audio.

DISCLOSURE OF INVENTION

Objects of the invention include providing complete messages, such as advertising (ads), within time frames of elevator or other shuttle car travel between service landings, and/or in the time between when a call for service is made and when the call is serviced by a car; and recording indications of instances of complete advertising message delivery for billing purposes.

The invention is predicated on the facts that within the car of a shuttle, such as an elevator, the duration for a message is limited to the amount of time required to travel from a given landing to the next landing where someone is to board or leave the shuttle, and at shuttle landings, such as elevator corridors, the time duration within which a message may be played is limited by the time it takes for the shuttle to answer a call in a given direction.

According to the present invention, a message is selected which can play in the expected time remaining before opening a door for access to a car or a landing, and is played within the perception of passengers (i.e., in the car or at the landing).

In further accord with the invention, the elapsed time for a shuttle car to make trips from one landing to the next landing to be serviced is estimated, and messages which will play completely within that time are selected to be played in the car during that time. According further to the invention, estimated remaining response time for an assigned shuttle car to respond to a call for service is utilized to select a message to be played at the landing where the call was registered, which will play completely within that time.

The invention may seek to play a message having the longest playing time that will essentially utilize all of the estimated time, or it may continuously select and play messages of various times until the estimated time has substantially expired.

In still further accord with the invention, reassignments which could cause car service to take less time than the time of a selected message are discouraged, but not prevented, by means of penalties provided to the dispatching algorithms. In still further accord with the present invention, messages of a suitable duration may be selected on a rotating basis and/or dependent upon other factors such as the day or hour, the particular landing involved, or the load in a car. If no suitable message can be found, a background program (which might comprise background colors and soothing music) may be selected to be played. The invention not only provides the opportunity for useful advertising, including advertising revenue and business enhancement that can result therefrom, it also provides an opportunity to deliver messages to employees, and the like. The invention further distracts passengers from the boredom which can result from delays in service, thereby enhancing the impression of good service.

Other objects, features and advantages of the present invention will become more apparent in the light of the following detailed description of exemplary embodiments thereof, as illustrated in the accompanying drawing.

BRIEF DESCRIPTION OF THE DRAWINGS

FIG. 1 is a logic flow diagram of a floor ad selection routine for selecting a message to be played while persons wait at a floor for an elevator to respond to a hall call.

FIG. 5 is a logic flow diagram of a floor ad selection routine which is an alternative to the embodiment of FIGS. 1 and 2.

BEST MODE FOR CARRYING OUT THE INVENTION

Figure 2:
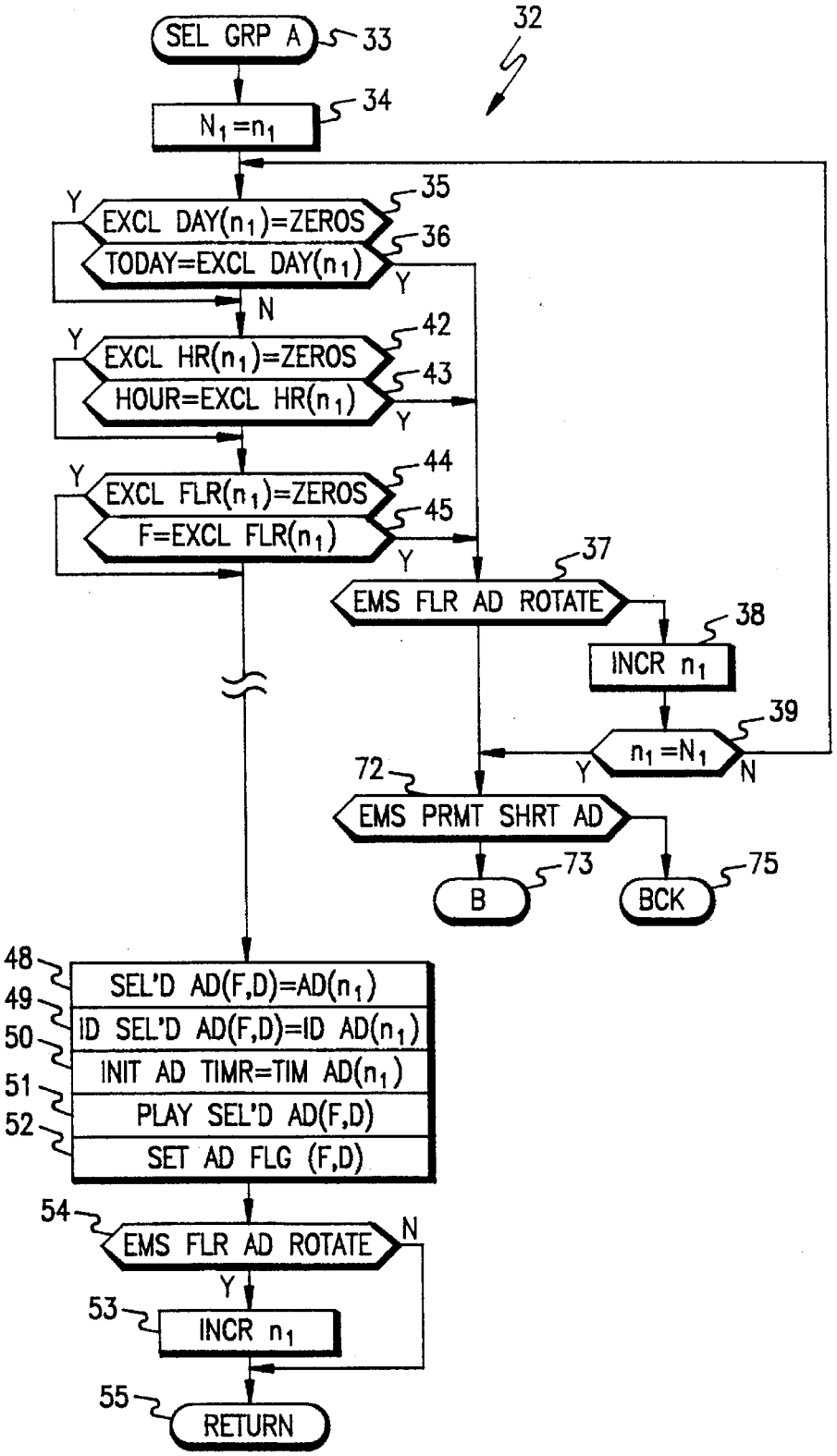
FIG. 2 is a logic flow diagram of a select group A subroutine for use in the routine of FIG. 1.

The invention herein is described only in terms of elevators, but the invention is also applicable to other types of shuttle transports, such as those used as people movers in airports and universities, in which a car traverses a predetermined path, providing access at predetermined points along the path, either automatically, or in response to requests for service. A shuttle usually makes a run between stops in a few minutes or a fraction of a minute, but in all events, in a few tens of minutes or less. As used herein, the term "shuttle" therefore means elevators, in which case landings or stops refer to floors, and the term "shuttle" also means light rail horizontal people movers having cars moved by ropes, linear induction motors, or otherwise, in which case landings or stops refer to preselected points where the car stops, or where it may stop in response to service requests. In the case of horizontal shuttles, the car may traverse either direction on precisely the same path, or may traverse only in a single direction about a closed loop path, or it may traverse in one direction on one path, and traverse in the opposite direction on an adjacent path. The precepts of the invention may be adjusted accordingly with respect to the need to keep track of directions, in dependence upon the particular shuttle system in which the invention is implemented. For instance, the term "D" of FIGS. 1 and 5 is unnecessary in a shuttle having a unidirectional closed loop or employing parallel paths with independent landings for the respective directions. The invention may be used in the cars of the system or at the landings of a system or both.

A first aspect of the present invention relates to selecting messages to be played in elevator corridors for viewing by potential passengers waiting for service after having pressed a hall call button. In elevator corridors, it is likely that calls will be made for service in both the up and down directions nearly contemporaneously, so passengers intending to travel in opposite directions will be present at the same time. It is obvious that the length of time that passengers will wait for travel in one direction is nearly always different than the length of time that passengers will wait for travel in the opposite direction. Typically, there may be no outstanding hall calls at a particular corridor; and then passengers approach to request service in a first direction; thereafter, passengers may approach to request service in the opposite direction. When the first call has been registered, it is impossible to know whether or not a second call may become registered before the first call is serviced. And there is, of course, no way to tell how long it will take to answer a call until after the call is made and processed for a car assignment, in the usual fashion. Therefore, in this embodiment of the invention, only the first registered hall call is utilized in the routine of FIG. 1 to determine a message which can be played prior to response to the first hall call. Any second hall call is ignored in this routine, unless it is still registered after the first hall call is serviced (which certainly could happen if the first hall call is serviced quickly and the second hall call is not responded to for a long time).

In the remainder of this description, the term "ad" may be used to indicate both advertisements and non-commercial messages of any sort. The messages may be audio only or audio-visual, from a variety of media, including tape cassettes and compact disc read only memories. All of this is irrelevant to the invention.

In FIG. 1, a floor ad select routine, utilized to select a message for showing to persons waiting for response to a hall call in an elevator corridor, is reached through an entry point 11. A first test 12 determines if an elevator management system (EMS) associated with the elevators has enabled displaying messages, such as ads, at the various floors to prospective passengers awaiting service. If, due to extremely heavy traffic, elevator renovations, or any other reasons, the EMS indicates floor ads should not be displayed, a negative result of test 12 causes the routine of FIG. 1 to revert to other programming through a return point 13. If floor ads are enabled, an affirmative result of test 12 reaches a step 14 to set a local direction indicator, D, to the up direction. Then a step 15 sets a local floor counter (F CTR) to a number identifying the highest floor in the building; the steps 14 and 15 initialize the routine for examining all of the floors in both directions to determine whether any should have messages commenced, and to select the message therefor.

Once initialized, the routine of FIG. 1 reaches a test 18 to determine for the first floor being tested (in this case the highest floor) whether or not a message has been initiated, as indicated by an ad flag for floor F. The ad flag for floor F is taken to be present if either the ad flag for the up direction or the ad flag for the down direction is present. Assume initially that no ad has been initiated on that floor; a next test 19 determines if there is a hall call for that floor in the current direction (up). If not, the program advances to a step 20 where the floor counter is decremented to point to the next floor in turn, and a test 21 determines if the floor counter has been decremented all the way to the lowest floor, meaning that all the floors have been examined in one direction. Initially, this will not be the case, so a negative result of test 21 will cause the program of FIG. 1 to revert to the test 18. Once again, the ad flag for the current floor is examined to see if there is an ad or other message in progress on this floor. Assuming there is not, once again, the test 19 is reached to determine if there is a hall call on the second floor for the current direction (up). Assuming there is a hall call, an affirmative result of test 19 reaches a step 24 where the car which has been assigned the hall call at this floor and in this direction is identified as "p". Then a factor indicating how long it is expected that passengers will have to wait for service, wait time, is identified as the remaining response time (as is known in the art), for the assigned car to reach the call at this floor and direction. The wait time determines the length of time within which a message must play in order to be observed in its entirety.

To select a suitable message, a series of tests compare the wait time with successively lower thresholds of time for groups of available messages. For instance, the test 26 compares the weight time to see if it is at least as great as the time threshold for group A, the group of messages that take the longest time. Within the group, the messages need not all be exactly the same length, but simply be achievable within a certain maximal amount of time (such as, perhaps, 45 seconds). Similarly, the test 27 compares the wait time against a second threshold of time which is lower than the threshold for group A, to see if the various messages in group B can be played in their entirety within the wait time. The second threshold, that for group B, may, for instance, be on the order of 30 seconds. Other tests may be performed for intermediate groups, and a test 28 determines if the wait time is greater than some minimal value, which may be on the order of 5 or 10 seconds.

If the wait time is long enough, an affirmative result of test 26 will reach a subroutine 32, which is illustrated in FIG. 2, to select a message from group A. In FIG. 2, the routine 32 is reached through an entry point 33 and a first step 34 sets a temporary number value, $N_1$, equal to a repeating number value, $n_1$, that allows rotating among a variety of ads, instead of playing the same one all of the time, as is about to be described. Then a test 35 determines if the ad in group A identified by the number n has any day exclusions in a map of day exclusions relating to it. Thus, a restaurant ad may be played on Tuesday through Friday, but excluded on Monday when the restaurant is closed. Or, a happy hour ad might be excluded on Monday through Thursday, and played only on Friday when its response will be rewarding. If the map of exclusive days for ad $n_1$ is not all zeroes, a test 36 determines if today (in real time) is an excluded day for this ad. Assuming that it is, an affirmative result of test 36 will reach a test 37 to determine if the elevator management system has ordered that the ads be rotated, which normally would be the case. In such a case, an affirmative result of test 37 will reach a step 38 which increments $n_1$ to point to the next ad in the group A set of ads, and a test 39 determines if $n_1$ equals $N_1$, which would indicate that all of the ads in the group have been tested, unsuccessfully. The mechanism for achieving this is causing the incrementing of the $n_1$ counter to be modulo the number of ads in group A so that it will step through identifying each of the ads and back to the first one, as it is incremented. Assuming that not all of the ads have been examined, a negative result of test 39 causes the subroutine of FIG. 2 to revert to the test 35 to again make the day exclusion test for the next ad in group A. If there are no exclusions, or if today is not one of them, a test 42 will be performed to determine if there are any hour exclusions for the particular ad. The hour exclusion might be used to play lunch ads only at midday, or luxury car ads only late in the day. If so, a test 43 determines if the current hour in real time is an excluded hour for this ad. If it is, the steps and tests 37–39 will be reached again and the process repeated for the next ad. But if this ad is not excluded during this hour, a pair of tests 44, 45 similarly examine this ad for a floor exclusion, against the current floor F. The floor exclusion might be used to play employee messages only on the floors of a particular employer, or to avoid advertising on floors where tenants have an objection thereto. The foregoing tests 35, 36, 42–45 are exemplary merely, and other tests could obviously be used to assist in selecting a desired ad or other message.

If ad $n_1$ of group A is to be played, a step 48 causes a selected ad to be played at this floor for the call in this direction to be: ad $n_1$ of group A. A step 49 causes the identification number of the selected ad for this floor and direction to be set equal to the identification number of ad $n_1$ of group A. A step 50 initiates an ad timer for this floor and direction as equal to the time it takes to run ad $n_1$ of group A. A step 51 initiates the running of the selected ad and a step 52 sets the ad flag for this floor and direction (the flag tested at test 18 (and otherwise, as is about to be described) in FIG. 1. Note that the ad flag is not set unless an ad is actually selected and started to play and its timer started as well. Then a step 53 increments the $n_1$ counter if a test 54 indicates that the EMS has established rotating ads; and the routine of FIG. 1 is reverted to through a return point 55.

In FIG. 1, when the program returns from the select group A subroutine 32, it reaches the step 20 which decrements the F counter so as to point to the next floor in turn, and the test 21 determines if all of the floors have been tested in this direction, or not. Assuming they have not, a negative result of test 21 causes the routine of FIG. 1 to revert to the test 18 once again. Assume this time that the particular floor in question has an ad playing in its hall corridor. An affirmative result of test 18 will reach a test 57 to determine if the ad flag has not only been set for this floor, but for this particular direction. Assuming that a message is running in response to a hall call at this floor and in this direction, so that the ad flag for this floor and direction has been set, an affirmative result of the test 57 will reach a step 58 in which a minimum remaining response time for a reassigned elevator is set equal to the current setting of the ad timer for this floor and direction. Therefore, should this call be reassigned for any reason, the assignment or reassignment program will compare the estimated remaining response time, for the car which has newly been assigned to this hall call, with that established in the step 58, and not allow the assignment unless the newly assigned elevator would take as least as long to answer the call as it will take to finish running the ad. Of course, this feature might be placed under EMS control, or not used at all, if it is thought to provide too much interference with elevator dispatching. For instance, between the test 57 and the step 58, a test similar to the test 37 of FIG. 2 might bypass the step 58 unless enabled by the EMS. However, all service is perceived as being quicker when passengers are distracted by a message.

In response to an affirmative result of test 57, following step 58, a test 59 determines if the lantern has been operated to announce the arrival of an elevator to service the call at this floor and direction. The announcement is taken to be the time when the ad must be completed because thereafter people are not paying attention to the ad so its value is diminished, and if people are watching the ad, it will add to confusion in the movement of people toward the elevator and the boarding of same. Therefore, if the lantern has been operated, an affirmative result of test 59 reaches a step 60 which resets the ad flag for this floor and direction, meaning that this floor is no longer considered to have an ad playing (for tests 18 and 57, for instance). Then, a test 61 determines if the ad timer has timed out for the ad running for this floor and direction, as determined in step 50 of FIG. 2. If the ad has not timed out by the time the lantern is operated, a negative result of test 61 reaches a step 62 which turns the ad off immediately, thereby to avoid passenger movement problems. The negative result of test 61 also bypasses a pair of steps 63, 64 which record the present real time and the ID number of the ad which has just run. Thus, if the ad is not completed by the time the lantern has sounded, steps 63 and 64 are not performed and there will be no charge for running the ad. This provides an assurance to the advertisers and others that satisfactory results will be achieved even in the elevator environment.

On the other hand, if the ad flag is set for this floor, but not for this direction, an affirmative result of test 18 followed by a negative result of test 57 will reach a step 65 in which the minimum remaining response time for a newly assigned elevator to reach the call at this floor and direction after reassignment is set to some maximum value, meaning any reassignment can pass this test.

In a typical case, the program of FIG. 1 will be performed several times per second. With respect to a call on any floor for a given direction, if an ad is playing with respect to that call, a typical result is that the routine will have quite a few passes through affirmative results of tests 18 and 57, passing through step 58, and reaching a negative result of test 59. This is while the ad is playing to the waiting passengers. In each case, the program then advances to the step 20 to decrement the F counter to point to the next lower floor in sequence and then reaches the test 21 to determine if all of the floors have been handled in the given direction. In each case where all the floors have not been handled, a negative result of test 21 causes the program to revert to test 18, as described. And then, either nothing happens, or if an ad is running for that floor and direction, the lantern is tested in test 59, or a new hall call will have a call assigned to it as described hereinbefore with respect to FIG. 2.

Eventually, all the floors will be tested in the up direction, so an affirmative result of test 21 reaches a test 68 to determine if the direction indicator, D, indicates the down direction. Initially, it will not, so a negative result of test 68 reaches a step 69 which sets the indicator, D, to the down direction. And then the program of FIG. 1 reverts to step 15 to once again set the F counter to indicate the highest floor in the building, and all of the floors are tested for hall calls in the down direction, either assigning ads to be played for new down hall calls (as described with respect to FIG. 2 hereinbefore) or testing the lantern to see if the ad should have been completed or not, as described with respect to test 59 hereinbefore, or doing nothing if an ad is playing in the opposite direction or there is no hall call on that floor. Eventually, once again all the floors will have been tested in the down direction and so an affirmative result of test 21 reaches the test 68; this time, test 68 is affirmative so other parts of the program are reverted to through the return point 13.

Referring again to FIG. 2, a feature which may be utilized in selecting ads for play in particular instances may be utilized if no suitable ad is found: that is, as described hereinbefore, if an ad fails to pass the exclusions and the EMS does not permit cycling among various ads, but only playing a certain ad of each group, then a negative result of test 37 will reach a test 72 to see if the EMS is set to permit using a shorter ad than one of the ads in the group which could play in the allotted time. If the EMS does permit playing a shorter ad, then an affirmative result of test 72 will cause the program to advance through a transfer point 73 to a subroutine 74 (FIG. 1) which will select an ad from group B (similar to the manner in which the subroutine of FIG. 2 selects an ad from group A). On the other hand, if the EMS has not been set up to allow running a shorter ad, a negative result of test 72 will cause the program to advance to a transfer point 75 to reach a step 76 in FIG. 1 which will run a background program (such as moving colors and soothing music). The background program may be run in response to step 76 whenever the predicted waiting time for a call is less than some minimum amount (e.g., nearly instantaneous), thereby causing a negative result of test 28. The use of the background program may be found desirable so as to train people to focus attention on the audio, or both audio and video. On the other hand, if desired, the use of a background program may be found undesirable if it is determined that more impact is achieved by initiating only a program which it is desired for people to pay attention to. Thus, in each instance of implementing the present invention, a background program may be used, or not, as desired. Furthermore, an EMS test to determine whether or not it should be used, settable by the management system, may be employed (in the same fashion as the tests 37, 72 of FIG. 2).

In FIG. 1, if the waiting time does not exceed the threshold for group A, group B or any other groups not shown, but does exceed a minimum threshold, then an affirmative result of test 28 may reach a select group minimum subroutine 77 which operates in a manner similar to the subroutine 32 described with respect to FIG. 2 hereinbefore. And, the subroutine 77 might be reached through a transfer point 78 if a group having a higher threshold is unable to select an ad and the EMS permits selecting a shorter ad, as described with respect to FIG. 2, hereinbefore.

In FIG. 2, if test 37 indicates that cycling of the ads is permitted, but none of the ads are able to pass the tests 35, 36, 42–45, so that eventually an affirmative result of test 39 is reached, this will also reach the tests 72 to determine if the shorter ad should be selected through the transfer point 73 or whether the background program should be run through the transfer point 75.

The foregoing describes some of the problems associated with running ads for persons waiting for a response to a hall call, and some of the features which the present invention provides in running such ads (or other messages). Problems associated with running ads within the elevator car are different than those related to ads for passengers waiting in elevator corridors. In the case of corridors, once a hall call is assigned to a car it is not liable to be reassigned to another car unless the timing has increased. That is, in typical dispatching scenarios it is more likely that the present assignment becomes less good before assignment to another car looks better. On the other hand, inside of an elevator car, passengers waiting to register their intended destinations could cause the car to stop at a landing before an ad is completed. Also, assignment of the car to answer a hall call can frequently cause the car to stop before any passenger initiated car call is reached. And, even in systems which immediately assign each hall call to a particular car for response, the assignment to a car can occur at a time which will shorten an elevator's trip, unless suitable accommodation is made therefor.

Figure 3:
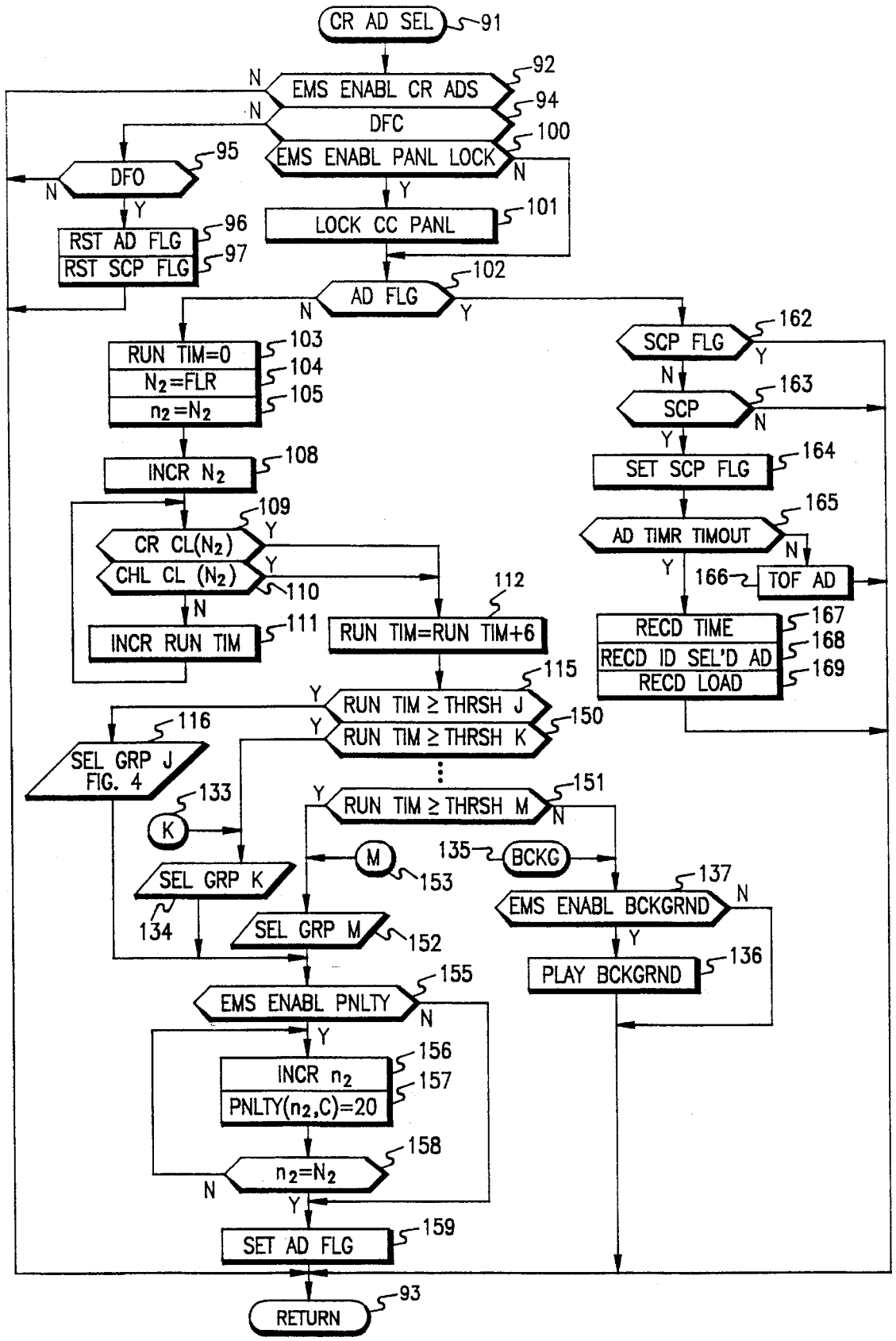
FIG. 3 is a logic flow diagram of a car ad selection routine for selecting an ad to play in an elevator car.

In FIG. 3, a car ad select routine is reached through an entry point 91 and a first test 92 determines if the EMS has enabled car ads. If not, the routine is bypassed by reaching a return point 93. Assuming car ads are enabled, a test 94 determines if the door of the car door is fully closed or not. If it is not, that means the car is either approaching or is at a landing. When the car is at a landing, and prior to being dispatched, its doors are fully open to enable passengers to enter and leave the car. This is taken to be a time when a cycle of ad running can be initiated. Thus, if the door is not fully closed, a negative result of test 94 reaches a test 95 to see if the door is fully open. If it is not, nothing further is done, and other parts of the program are reverted to through a return point 93. On the other hand, when the door is fully open, an affirmative result of test 95 reaches a step 96 which resets the ad flag (similar to the ad flag of tests 18 and 57 in FIG. 2) and a step 97 which resets a stop control point (SCP) flag, the purpose of which is described hereinafter. This initiates the car for the possible playing of an ad during its next run.

When the elevator is given direction and is about to embark, eventually the doors become fully closed. In a pass through the routine of FIG. 3, when the doors are first fully closed, an affirmative result of test 94 reaches a test 100 to determine if the management system has enabled locking the panel. If it has, a step 101 locks the car call panel so that no further calls can be entered by passengers. Obviously, this can be an element of great displeasure to passengers so that it might not be used in any given implementation of the present invention. On the other hand, in buildings in which ads are regularly run, passenger habit can quickly develop to ensure entering calls prior to the doors being totally closed. The use or nonuse of step 101 is therefore dependent upon the given utilization of the present invention. If panel locking is not to be undertaken, a negative result of test 100 bypasses the step 101.

A test 102 determines if the ad flag (reset in step 96) has been set yet or not. Initially, at the beginning of a run, it will not have been set, so a negative result of test 102 reaches a step 103 which sets the run time (the time it is estimated that the car will take to reach its next stop) equal to zero. A step 104 sets a locally used number, $N_2$, equal to the present floor number of the car. And a step 105 sets another locally used number, $n_2$, to be equal to the other number, $N_2$. These numbers $n_2$, $N_2$ are independent of the numbers $n_1$, $N_1$ used in FIG. 2. Then, a step 108 increments $N_2$ to point to the next floor in the direction of travel. Obviously, if the car direction is down, the incrementing will be a negative arithmetic, or decrementing operation. Then, a pair of tests 109, 110 determine if there is either a hall call to this floor or a car call at this floor in the direction of elevator travel. If not, a negative result of test 110 causes a step 111 to increment the run timer by one, which in this embodiment may be taken to equal one second per count (or not, if some other accommodation is taken). Then, the step 108 again will increment the floor count, $N_2$, in the direction of travel and the tests 109, 110 will determine if there is a hall call or a call car on the floor designated by $N_2$. If there is either a car call or a hall call, an affirmative result of test 109 or test 110 will reach a step 112 where the accumulated run time has added to it a factor of 6, such as 6 seconds. This will give a total run time equal to the time it takes to accelerate and decelerate between landings as well as the time it will take to pass each landing that might be indicated by the incrementing of run time in the step 111. Of course, the counting represented in the steps 111 and 112 are simplistic. Instead, the total number of floors may be compared against the normal elevator profile and even take into account the load or other factors so as to determine an estimated amount of time for the floor-to-floor travel of the car.

In any event, once the run time is estimated by whatever means, a test 115 will determine if the run time exceeds the threshold for a group, J, of long playing ads or other messages. If it does exceed that threshold, an affirmative result of test 115 reaches a select group J subroutine 116 which is illustrated in FIG. 4.

Figure 4:
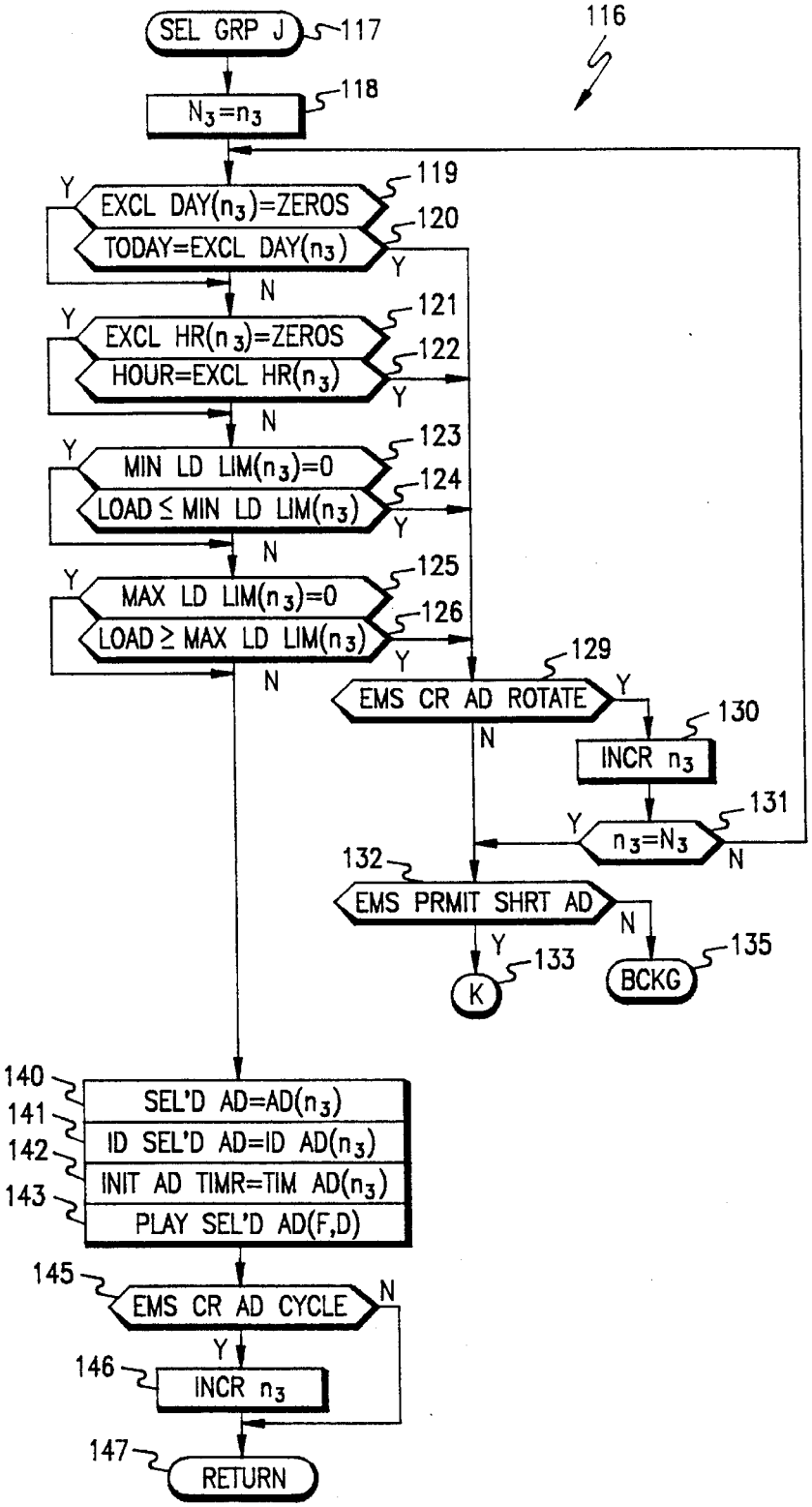
FIG. 4 is a logic flow diagram of a select group J subroutine for use in the routine of FIG. 3.

In FIG. 4, the select group J subroutine 116 is reached through an entry point 117 and a first step 118 sets a locally used, temporary number, $N_3$, equal to a locally used rotating number, $n_3$. The numbers $N_3$ and $n_3$ of FIG. 4 are not the same as and are totally independent of the $N_1$ and $n_1$, $N_2$ and $n_2$, used in FIGS. 2 and 3. Then, a plurality of tests 119–122 examine ad $n_3$ of group J for day and hour exclusions as described with respect to FIG. 2 hereinbefore. In the case of the car, there may be desired a limit as to the number of people in a car in order to run an ad. For instance, a country restaurant may wish to target its ads to full elevator cars, suggesting relief from the congestion, or a dating service may target its ads for empty elevators, to play on loneliness. In any event, a pair of tests 123, 124 can test an ad in the elevator for a minimum load, and a pair of tests 125, 126 can test the add in the elevator for play only with a large load. In the event that the particular ad fails one of the exclusions, a test 129 determines if car ads are to be rotated; if so, a step 130 will increment $n_3$ and a test 131 will determine if $n_3$ has cycled around and now equals its original number, $N_3$, as set in the step 118. If not, the next ad in turn is compared with the tests 119–126; but if all the ads have been tested, an affirmative result of test 131 reaches a test 132 to determine if short ads are permitted, and thereby reach, through a transfer point 133, a select group K subroutine 134 (FIG. 3). Or, if short ads are not permitted, a transfer point 135 will reach a step 136 in FIG. 3 to run a background program, provided a test 137 indicates that the EMS has enabled playing of the background program, in a fashion described with respect to step 76 in FIG. 1 hereinbefore.

In FIG. 4, assuming an ad passes all exclusion tests 119–126, a step 140 identifies the selected ad as ad number $n_3$ of group J, and a step 141 causes the ID of the selected ad to be set equal to the ID of ad $n_3$. The ad timer for this car is then initiated at the time that it takes to play ad $n_3$ in a step 142, and the selected ad is caused to be played (that is, the play is initiated) by a step 143. Then, a test 145 determines if the EMS enables rotating the ads, and if so, $n_3$ is incremented by a step 146; otherwise, step 146 is bypassed. Then the car ad select routine of FIG. 3 is reverted to through a return point 147.

In FIG. 3, if a negative result of test 115 indicates that the run time estimated for the ensuing trip of the elevator car does not exceed the threshold time for those ads in group J, then a test 150 determines if the run time exceeds the threshold time for ads in group K. If so, the select group K subroutine 134 (similar to that described with respect to FIG. 4) will be reached. In the same fashion, other tests may be performed to determine if the run time is long enough for ads of other groups. If it isn't long enough for any other groups, eventually a test 151 will determine if the run time is long enough for the ads in the minimum group, M. If it is, a select group M subroutine 152 will be reached, which is similar to that described with respect to FIG. 4 hereinbefore. This subroutine may also be reached through a transfer point, M, 153 in the event that no message from a group of longer messages has been selectable, as described with respect to FIGS. 2 and 4 hereinbefore. In any case where an ad is selected in any of the subroutines 116, 134, 152 or similar subroutines, a test 155 determines if the EMS has enabled a car unavailable feature which, if enabled, assists the car in not being assigned to hall calls which would interrupt the playing of the ad which has been selected. If enabled, an affirmative result of test 155 reaches a step 156 which increments $n_2$ (set to equal $N_2$ in step 105) to the first landing that the elevator will pass on its trip. And then a step 157 sets a penalty for that floor and the present car ($n_2$,c) to a value which reflects the balance between the desire to not interrupt ads on the one hand, but to not avoid necessary assignments of hall calls to elevator cars on the other hand. For instance, in terms of number of seconds it takes to respond to a call, the penalty might be 20 seconds; or it might be some other value, in dependence upon the particular system in which the present invention is implemented. The remaining AD TIMR value, initiated in step 142, FIG. 4, could be used as a penalty, if desired (similar to step 58, FIG. 1). The use of the penalty will vary as between relative system response penalties on the one hand and pure remaining response time penalties on the other. But this is irrelevant, the invention being usable in either type of system, and in other types of hall call assignment dispatching systems. In any event, the delays due to penalties for playing ads will be perceived less by passengers who are distracted by messages. A test 158 determines if all of the floors between the starting floor and the ending floor, $N_2$, have had penalties ascribed to them, or not. Initially, they will not have, so a negative result of test 158 causes step 156 to increment $N_2$ to the next floor in turn, and ascribe a penalty to it, as well. The steps and tests 155–158 therefore permit, if desired, biasing the hall call assignment system so as to tend to favor the non-interruption of trips where ads are playing, unless the current traffic situation demands use of that elevator for a particular call. Then the ad flag is set in step 159 to indicate that this car has an ad program playing. The steps and tests 155–159 are shown in the car ad select routine of FIG. 3, rather than in the individual subroutines that select ads, because they are not ad-dependent, being the same regardless of which ad may have been selected. In contrast, the steps and tests 140–146 are unique to the group or to the ad itself which is selected. After selecting an ad and passing through the steps and tests 155–159, other parts of the program are reverted to through the return point 93.

In FIG. 3, if the run time is less than that established for any of the groups, so the tests 115, 150 and 151 are all negative, then the background program may be played by step 136 if enabled by the test 137, as is described hereinbefore.

Note that the assignment of an ad to play in this car, providing the penalties, or playing a background program will occur only when the test 102 has a negative result, because the ad flag has not been set, indicating that there is no ad running in the car. In any pass through the routine of FIG. 3 after the ad flag has been set and before completion of the elevator run or completion of playing the ad, test 102 will be affirmative reaching a test 162 which tests the SCP flag (stop control point) flag to see if it has been set or not. Since it is reset at step 97 while the car is at the landing, it initially will not be set. A negative result of test 162 reaches a step 163 to see if the car is within the stop control point of a landing. Until it is close to the landing where it is to stop, this will not be the case, so initially a negative result of test 163 will cause other parts of the program to be reverted to through the return point 93. Eventually, the car will approach the landing where it is to stop, and an affirmative result of test 163 will reach a step 164 which sets the stop control point flag, and a test 165 determines if the ad timer has timed out or not. If it has not, a negative result of test 165 reaches a step 166 which causes the ad playing in the car to be turned off. The negative result of test 165 also causes the routine to bypass a series of steps 167–169 which cause real time, the ID of the ad which has been run, and the load in the car to be recorded, for billing purposes. In other words, as in the case of FIG. 1, the ad is not billed unless it is completed, as indicated by an affirmative result of test 165 indicating that it has run completely prior to reaching the stop control point of the next floor landing where the car will stop. And, the approximate number of passengers in the audience can be used in pricing for each playing of the ad.

Referring now to FIG. 5, a second embodiment of the invention utilizes the first few elements 11–19 of the embodiment of FIG. 1, and the last few elements 20, 21, 68 and 69 of the embodiment of FIG. 1, but replaces everything between the tests 18 and 19 and the F counter decrement step 20, including the select group A subroutine 32 of FIG. 2. In each pass through FIG. 5 in which floor ads are enabled, the ad flag test 18 is reached to see if there is an ad flag set for the up direction or down direction for the floor under consideration. If no ad is already playing on the floor in question, a negative result of test 18 will reach to see if there is a hall call registered at this floor in the direction under consideration. As in the prior embodiment, if there is not, a negative result of test 19 reaches the step 20 to decrement the F counter to point to the next floor in turn for consideration. If there is a hall call on this floor in the direction under consideration, an affirmative result of test 19 reaches a step 172 which sets a car number, p, equal to the number of the car which has the hall call for this floor and direction assigned to it. A step 173 sets the wait time equal to the remaining response time for car p to reach the hall call at this floor and direction, and a step 174 initiates a wait timer for this floor and direction to be equal to the wait time for the present call. Then a step 175 sets a temporary number value, $N_4$, equal to a repeating number of value $n_4$, that allows rotating among a variety of ads, selecting one that is available to play, and bypassing those that are not. A test 178 determines if the first ad being examined to see if it can play, $AD(n_4)$, is already being played, or not. In this embodiment, it is assumed that any given ad is not capable of being played partially simultaneously, at different starting times, for different corridors or cars. Thus, if the ad timer has not timed out, that means that the particular ad is not available, and a negative result of test 178 will reach a step 179 to increment the $n_4$ counter to point to the next ad in the set, and a test 180 determines if all of the ads have been examined in this attempt to assign an ad for playing, by comparing $n_4$ with $N_4$. Until all of the ads have been examined, test 180 will be negative, returning the routine to test 178, to determine if the next ad in turn is available. Assuming it is, a test 181 determines if the EMS has enabled a feature which allows an ad to be played only once during each building run of an elevator (that is, in a given direction, up or down). If it has, a test 182 determines if this particular ad has been played during this run of the elevator. If it has, an affirmative result of test 182 reaches a step 179 to reach the next ad for consideration. But, if either the once only feature is not enabled or the ad has not been played in the current run of the car, a negative result of either test 181 or 182 will reach a test 183 to determine if the play time for the ad under consideration exceeds the wait time for this particular call. If it does, this ad is eliminated by an affirmative result of test 183 reaching step 179 to point to the next ad in turn. If, however, the ad is sufficiently short in playing time, a test 184 determines if the EMS has enabled testing for exclusions, in a subroutine 185, which may be the same or similar to those illustrated in tests 36, 43, 45, FIG. 2, hereinbefore. If exclusions are permitted, and any exclusion is applicable, an affirmative result of one of the tests in the subroutine 185 will eliminate the ad in question by reaching step 179. But if exclusions are not permitted, or none of them are applicable to this particular ad, a negative result of either test 184 or subroutine 185 will reach a series of steps to get the ad playing.

A step 188 identifies the selective ad for this floor and direction as $AD(n_4)$. Then the ID of the selected ad is set equal to the ID of ad $n_4$ in a step 189. A step 190 causes the selected ad to be played, a step 191 initiates an ad timer for this floor and direction to be equal to the predetermined time for running ad $n_4$, a once flag is set for the ad being run at this floor in a step 192, and the ad flag for this floor and direction is set in a step 193. Then the step 20 is reached to decrement the F counter to point to the next floor in turn (as described with respect to FIG. 1 hereinbefore) and revert to the test 18 to see if the ad flag is set for this next floor.

If the ad flag is set for this next floor, an affirmative result of test 18 reaches a test 57 (the same as in FIG. 1) to determine if the ad flag is set for this floor and direction. If it is not, a negative result of test 57 may reach a step 65 to set the minimum reassignment remaining response time for a call in this floor and direction to some maximum value, so that any new reassignment remaining response time will be less than that and the reassignment will be permitted. This is permissible, as described hereinbefore, since no ad will be interrupted as a consequence of a call in this particular direction. And then the next floor in turn is given consideration by the program advancing through the F counter decrement at step 20. On the other hand, if the ad which is running on this floor was initiated because of a call in the current direction, an affirmative result of test 57 reaches a step 58 where the minimum reassignment remaining response time for the call in this direction at this floor is set equal to the remaining time of the ad timer for this floor and direction. And then a test 59 (as in FIG. 1) determines if the lantern has been operated to announce the arrival of a car to answer the call at this floor, in this direction. If it has, that means that the call is about to be answered and the ad should have finished playing. An affirmative result of test 59 reaches the step 60 (as in FIG. 1) to reset the ad flag for this floor and direction and then a step 196 will reset the once flags for all of the ads that may have played at this floor during this run of the elevator (any of them set by step 192, described hereinbefore). And then the test and steps 61–64 are performed to either turn off the ad or record the particulars for billing purposes, as described with respect to FIG. 1. And thereafter, the next floor in turn is given consideration by the program passing through the F counter decrement at step 20.

During the general waiting time for any call, while the ad is running, affirmative results of test 18 and 57 will pass through step 58 to update the minimum reassignment RRT, and a negative result of test 59 will reach a step 197 to determine if the ad is still running or not. If its timer has not timed out, it is still running, so a negative result of test 197 causes nothing to happen, and the next floor in turn is reached through the step 20. But when this ad has timed out, then a test 198 determines if the remaining time within which an ad may be played is less than some minimum amount (such as a few seconds) within which no ad could play. If there is insufficient time for any further ads, an affirmative result of test 198 reaches a test 199 to see if the EMS permits running a background. If not, nothing further is done, and the next floor in turn is given consideration through the step 20. But if the EMS does permit playing a background, a step 200 may initiate the playing thereof.

If the lantern has not been operated, and the ad which has been running has timed out and there is sufficient time to perhaps run another ad, a negative result of test 198 will reach the step 175 where $N_4$ is set equal to $n_4$ once again, since all of the ads can again be considered to see if they should be played. The difference now from the first time an ad was selected in response to a hall call being registered, is that there is less time now than there was before and at least one of the ads has been played so its once flag will have been set. The process within the steps and tests 178–180 is repeated as before and if a suitable ad can be found, the steps 188–193 are repeated for that ad to play on this floor in response to the hall call in the same direction as before. Thus, in the embodiment of FIG. 5, several ads may be played while waiting for an elevator car to answer a hall call in a given direction.

Another embodiment of the invention, which is obvious in view of the embodiments of FIGS. 1 and 2 of FIG. 5 may initially select a longest playing ad in accordance with the tests 26–28 of FIG. 1 in response to an EMS enablement to do so, and after it concludes, attempt to assign a smaller ad to play during the remaining time as in the embodiment of FIG. 5. One simple way to achieve this is to assign the longest ad to $n_4$ equal one; the next longest ad to $n_4$ equal two; and so forth so that the descending order of the playing time of the ads is reached with ascending values of $n_4$. Then, in a step within the block of steps 172–174 of FIG. 5, $n_4$ can be set equal to one so that the first attempt to assign an ad to play for a particular hall call will first play the longest ad that will fit, and thereafter play any ad it can find as described with respect to FIG. 5 hereinbefore. However, if random ad playing is preferred, then such a feature need not be used. A mix of various longest ads, on the other hand, is achieved with the embodiment of FIG. 1, which could be modified with some other features (such as tests 197 and 198) in FIG. 5 to combine the features of FIGS. 1 and 5.

Figure 6:
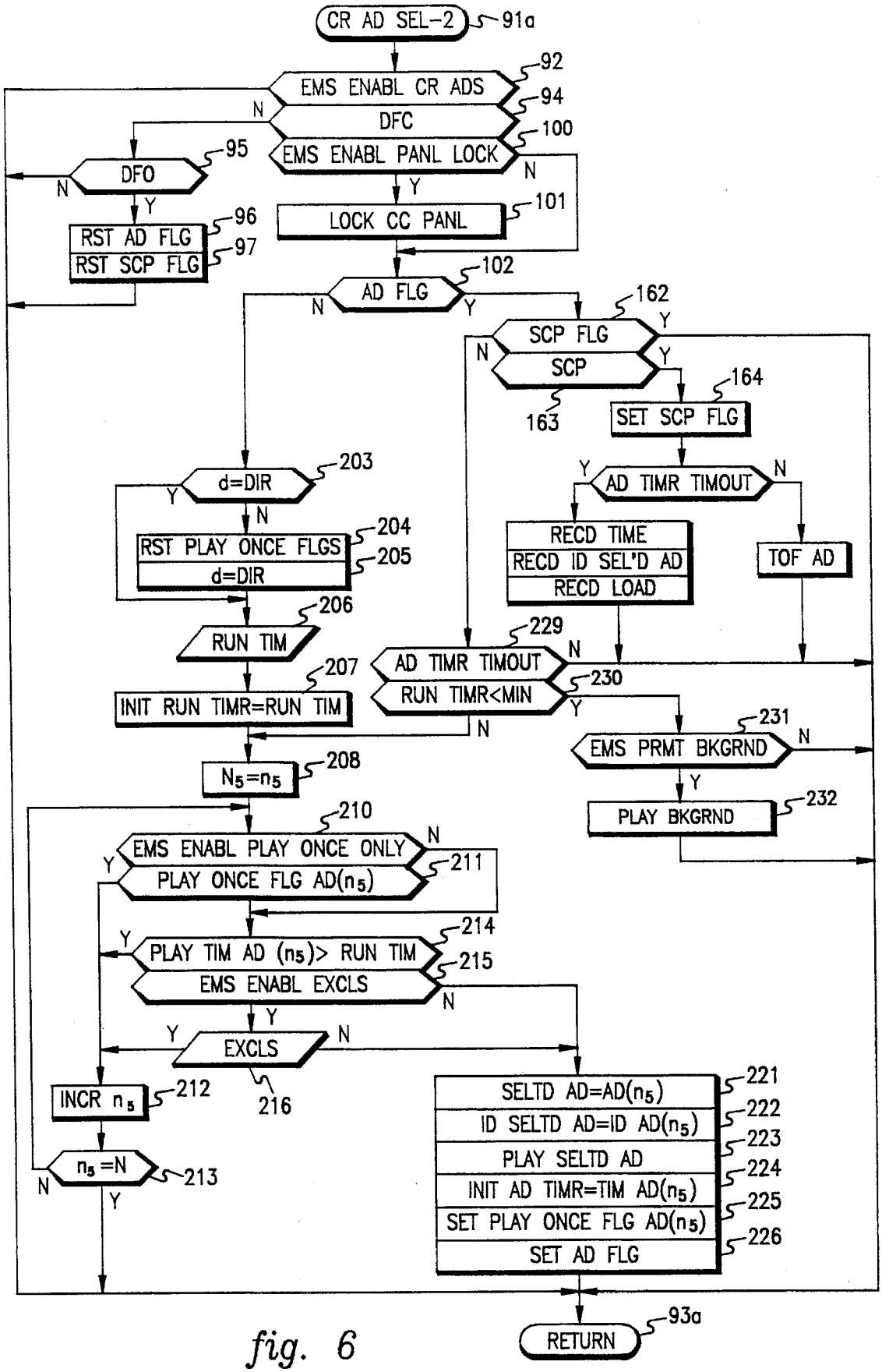
FIG. 6 is a logic flow diagram of a car ad selection routine which is an alternative to the embodiment of FIGS. 3 and 4.

Referring now to FIG. 6, a car ad select routine of a second embodiment of the invention is reached through an entry point 91*a* and a plurality of steps and tests 92–102 are the same in FIG. 6 as described hereinbefore with respect to FIG. 3. At a given moment when a computer program is passing through the routine of FIG. 6, if no ad is running in the car, a negative result of test 102 will reach a test 203 to see if a direction flag, d, has been set to be equal to the current car direction (DIR). If it has not been set to the present direction, a negative result of test 203 reaches a step 204 which resets any play once flags for any ads related to the car which may have been set (similar to the play once flag of test 181 and step 192 in FIG. 5). Then a step 205 updates the direction flag, d, to be equal to the current direction of the car. Then a subroutine 206 determines the estimated run time for this car to advance from its present floor to the next floor where it is to provide access, in any manner described with respect to FIG. 3 hereinbefore, or otherwise. Once the run time is known, a step 207 initiates the run timer to be equal to the run time. And, local ad numbers $N_5$ and $n_5$ are made equal in a step 208.

Now an ad will be selected, beginning with a test 210 which determines if the EMS limits playing each ad only once during a run through the building. In the case of ads playing in the car, the same passenger is quite likely to remain through several floor-to-floor runs in traveling to an ultimate destination floor; therefore, if desired, ads may be played only once in a given direction of travel to avoid repeating to any given passenger. If the single play feature is enabled, an affirmative result of test 210 reaches a test 211 to see if this ad has been played as the elevator travels this time in the current direction, or not. If it has, an affirmative result of test 211 reaches a step 212 which increments an $n_5$ counter to point to the next ad in turn, and a test 213 determines if the next ad in turn has already been examined. If not, the routine reverts to the tests 210, 211 to see if the next ad has been played, or not. If the EMS has not enabled a single play feature, a negative result of the test 210 bypasses the test 211. If the ad is available, a test 214 determines if the play time for this ad, $AD(n_5)$, exceeds the run time to the next floor. If it does, the ad is eliminated by the routine advancing to the step 212. If the ad has a suitable playing time, an affirmative result of test 214 reaches a test 215 to see if exclusions have been enabled by the EMS. If so, an exclusions subroutine 216 (similar to that described with respect to FIG. 4 hereinbefore, or otherwise), is run to determine if any ad should be excluded. If no ad should be excluded, or the exclusions are not enabled, a negative result of either test 215 or the subroutine 216 will reach a series of steps to put the ad in play. A step 221 causes the selected ad to be the current ad under consideration, $n_5$. Then the ID of the selected ad is set equal to that of the one selected in a step 222. And the selected ad is caused to be played by a step 223, the ad timer is initiated to the time of the selected ad in a step 224, the play once flag for this ad is set in a step 225, and the ad flag is set in a step 226. Then the program is reverted to through the return point 93*a*. In the next pass through the routine, the car is still on the same trip, and it will reach the test 102 where the result is affirmative. This reaches the test 162 (the same as described with respect to FIG. 3 hereinbefore) and initially, the car will not be approaching the next landing where service is requested, so a negative result of test 162 reaches the test 163. This too will initially be negative reaching a test 229 which determines if the ad timer has timed out or not. If it has not, the original ad is still playing, and nothing further is done; other program is reverted to through the return point 93*a*.

At some point, the first ad to be selected may time out and an affirmative result of test 229 will reach a test 230 to see if there is sufficient time remaining to play still another ad, or not. If the remaining time is less than some minimum, an affirmative result of test 230 will reach a test 231 to see if playing of background is enabled or not. If so, a step 232 starts the background playing. But if not, other programming is reverted to through the return point 93*a*.

If there is sufficient time to possibly run another ad before the car reaches the next service landing, a negative result of test 230 will reach the step 208 to once again set $N_5$ equal to $n_5$ so that only one pass through all of the ads will be attempted before exiting, if an ad cannot be found. And then the process described hereinbefore with respect to tests and steps 210–216 is repeated to see if an ad can be selected that will play in the remaining time. If it can, the steps 221–226 are repeated for the selected ad, as described hereinbefore. As described with respect to FIG. 5, a combination of embodiments may be made so as to tend to play long ads when they can be, and shorter ads when they cannot. And, in FIG. 6, simply by putting the ads in numerical order, with the longest playing ad having the lowest value of $n_5$, and by having a step within the block with step 207 to set $n_5$ equal to one, then selection of a long ad will initially be attempted for each floor-to-floor run. Thereafter, shorter ads may play.

The foregoing routines and subroutines are not necessarily descriptive of the precise manner in which functions according to the present invention must be performed, but are exemplary merely. In addition, the functions (such as exclusions, penalties, and reassignment criteria) all may be eliminated, or adjusted in any fashion which is deemed suitable in any implementation of the present invention.

In the car ad select routines of FIGS. 3 and 6, the estimated remaining response time determined otherwise for dispatching purposes may be used as the run time, instead of the counts indicated in FIG. 3 and similar profile time estimates.

As described, the embodiments herein play one or more messages between the time that service is requested (e.g., by pressing a hall call button or a car call button), and the time when the request for service is responded to (by providing an elevator at a floor in response to a hall call or delivering a passenger to a floor). In destination request elevator systems, even though pressing of a car call button in the elevator car is not required, ad service still may be provided in two parts, so that messages are not being played intentionally as people board an elevator, nor in any event as they exit from an elevator. In the present embodiment, the fact that the message being played for a call in one direction may still be playing when a call is answered for travel in the opposite direction necessarily results in the fact that persons boarding an elevator for travel in the opposite direction will be doing so while an ad is playing in the elevator corridor. That case would still exist in the case of destination request elevator systems.

While instantaneous car assignment dispatching systems may allow playing floor ads with little chance of interruption, the quick assignment of calls to cars can nonetheless interrupt car ads, unless some accommodation is made therefor as described hereinbefore.

In the case of messages playing in a car, the longest messages could be the time if would take for an elevator to run without interruption from the lowest floor to the highest floor. In the case of messages to be played for passengers waiting at a corridor, the longest message can be selected according to dispatching limits for the building.

If desired, the safety of passengers entering an elevator responding to a call in a direction opposite to that which initiated the playing of an ad may be accommodated by altering step 59 of FIG. 1 and/or FIG. 5 so that it is responsive to either lantern on a given floor to reset the ad flag, and either record the ad for billing or shut it off. That way, playing of the ad will not interfere with any passengers entering the elevator car. Premature shutting off of an ad is less of a problem when, as in FIG. 5, a series of short ads may be played in an elevator corridor, instead of one long ad. This is a matter of choice and is irrelevant to the invention.

The particular messages to be played may all be stored in a central place and transmitted when selected to the place where the message is to be played. Thus, there could be only one central point for all messages in an elevator group, or there might be one set of messages for each elevator hoistway, or one set for the hoistway and one set for each car. The messages might be stored as HDTV (high density television) format and transmitted over wide band-width medium to the places where they are to be played, or transmitted over telephone-type lines using an MPEG compression/decompression standard. On the other hand, analog signals may be utilized, similar to cable TV. Analog messages may be each stored on its own videotape, and selected by enabling a corresponding player, or they may be selected in any other suitable fashion, with appropriate transmission and playing accommodations. All of this is irrelevant to the present invention.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. A method of selecting and playing messages in an elevator system for conveying passengers in which a hall call is initiated by activating a corresponding hall call button, and having a controller for causing elevator cars to respond to such hall call, including providing access to cars through a hall door in an elevator corridor, comprising;

providing a plurality of predetermined messages, at least one of said messages having a duration different from at least another of said messages;

estimating the time remaining before the elevator system will provide access through said hall door;

selecting, from said plurality of messages, a message having a duration less than said estimated remaining time; and playing the selected message in the vicinity of and within the perception of passengers in said elevator corridor while said hall call registered for said floor is unanswered.

2. A method of selecting and playing messages in an elevator car which is associated with call devices for identifying selected floors to which passengers request to be delivered, and associated with a controller for causing said car to move to said floors to deliver said passengers and for causing said car to respond to hall calls assigned to said car to pick up passengers at related floors, comprising:

estimating, during a floor-to-floor run of said car, the time remaining for said car to advance to a first scheduled stop to either discharge or pick up passengers and providing a time signal indicative thereof;

providing a plurality of predetermined messages, each message having a playing time of a known duration;

comparing the time indicated by said time signal with the playing time duration of one or more of said messages;

selecting one of a plurality of said messages that have a playing time duration less than the duration indicated by said time signal based on a criterion other than its duration; and playing in said car said selected one message.

3. A method according to claim 2 wherein said playing step includes selecting successive messages on a rotating basis.

4. A method according to claim 2 wherein said playing step includes selecting a message based on the time of selecting the message.

5. A method according to claim 4 wherein said playing step includes selecting a message based on the time of day of selecting the message.

6. A method according to claim 4 wherein said playing step includes selecting a message based on the day of the week in which the message is selected.

7. A method according to claim 2 wherein said playing step includes selecting a message based on the load in said car at the time when said message is selected.

8. A method of selecting and playing messages in an elevator car which is associated with call devices for identifying selected floors to which passengers request to be delivered, and associated with a controller for causing said car to move to said floors to deliver said passengers and for causing said car to respond to hall calls assigned to said car to pick up passengers at related floors, comprising:

estimating, during a floor-to-floor run of said car, the time remaining for said car to advance to a first scheduled stop to either discharge or pick up passengers and providing a time signal indicative thereof;

providing a plurality of predetermined messages, each message having a playing time of a known duration;

comparing the time indicated by said time signal with the playing time duration of one or more of said messages;

playing in said car a selected one of said messages that has a playing time duration less than the duration indicated by said time signal; and at a predetermined point in time related to the conclusion of said run, recording an indication of the fact that said message has completed playing, if it has, or alternatively, turning off said message.

9. A method of selecting and playing messages in an elevator car which is associated with call devices for identifying selected floors to which passengers request to be delivered, and associated with a controller for causing said car to move to said floors to deliver said passengers and for causing said car to respond to hall calls assigned to said car to pick up passengers at related floors, comprising:

estimating, during a floor-to-floor run of said car, the time remaining for said car to advance to a first scheduled stop to either discharge or pick up passengers and providing a time signal indicative thereof;

providing a plurality of predetermined messages, each message having a playing time of a known duration;

comparing the time indicated by said time signal with the playing time duration of one or more of said messages; and playing in said car a selected one of said messages that has a playing time duration less than the duration indicated by said time signal; and at a predetermined point in time related to the conclusion of said run, turning off said message if said message has not completed playing, or alternatively, recording an indication of the fact that said message has completed playing, if it has, together with an indication of the load in said car.

10. A method of selecting and playing messages in an elevator car which is associated with call devices for identifying selected floors to which passengers request to be delivered, and associated with a controller for causing said car to move to said floors to deliver said passengers and for causing said car to respond to hall calls assigned to said car to pick up passengers at related floors, comprising:

providing a plurality of predetermined messages, each message having a playing time of a known duration;

at the start of a floor-to-floor run of said elevator car, estimating the time required for said car to advance to a first scheduled stop to either discharge or pick up passengers and providing a run time signal indicative thereof;

providing a plurality of threshold signals, each of said messages corresponding to one of said threshold signals, each of said threshold signals having a plurality of messages corresponding thereto, each one of said threshold signals indicative of the fact that a message corresponding thereto has a playing duration equal to or less than a duration corresponding to said one threshold signal;

comparing the time indicated by said run time signal with the durations indicated by said threshold signals and identifying one threshold signal having the largest corresponding duration which is less than or equal to the duration indicated by said run time signal;

selecting one message from among the plurality of messages associated with said one threshold signal; and playing in said car said one message.

11. A method of selecting and playing messages in an elevator car which is associated with call devices for identifying selected floors to which passengers required to be delivered, and associated with a controller for causing said car to move to said floors to deliver said passengers and for causing said car to respond to hall calls assigned to said car to pick up passengers at related floors, comprising:

estimating, during a floor-to-floor run of said car, the time remaining for said car to advance to a first scheduled stop to either discharge or pick up passengers and providing a time signal indicative thereof;

providing a plurality of predetermined messages, each message having a playing time of a known duration;

comparing the time indicated by said time signal with the playing time duration of one or more of said messages;

playing in said car one of said messages that has a playing time duration less than the duration indicated by said time signal; and upon completion of playing of said one message, prior to said car reaching said first scheduled stop, repeating said estimating step, said comparing step and said playing step.

12. A method according to claim 11 wherein said playing step includes playing each of said plurality of messages no more than once during each floor-to-floor run of said elevator.

13. A method of selecting and playing messages in an elevator car which is associated with call devices for identifying selected floors to which passengers request to be delivered, and associated with a controller for causing said car to move to said floors to deliver said passengers and for causing said car to respond to hall calls assigned to said car to pick up passengers at related floors, comprising:

estimating, during a floor-to-floor run of said car, the time remaining for said car to advance to a first scheduled stop to either discharge or pick up passengers and providing a time signal indicative thereof;

providing a plurality of predetermined messages, each message having a playing time of a known duration;

comparing the time indicated by said time signal with the playing time duration of one or more of said messages;

noting reversals in the direction of travel of the elevator; and playing in said car one of said messages that has a playing time duration less than the duration indicated by said time signal, each of said plurality of messages being played only once for each reversal of the direction of travel of the elevator.

14. A method of selecting and playing messages in the elevator corridors of a building served by an elevator system having hall call devices with which passengers may request elevator service at a corresponding floor of the building, and having a controller for causing an elevator car to move between floors of the building to answer hall calls and respond to passenger's requests for service, comprising:

estimating, in response to a passenger initiating a request for service in an elevator service corridor, the time required for an assigned car to respond to said request for service at said elevator corridor and providing a time signal indicative thereof;

providing a plurality of predetermined messages, each message having a playing time of a known duration;

comparing the time indicated by said time signal with the playing time duration of one or more of said messages;

playing in said elevator corridor one of said messages that has a playing time duration less than the duration indicated by said time signal.

15. A method according to claim 14 wherein said playing step includes selecting a message based on a criterion other than its duration.

16. A method according to claim 15 wherein said playing step includes selecting successive messages on a rotating basis.

17. A method according to claim 15 wherein said playing step includes selecting a message based on the time of selecting the message.

18. A method according to claim 17 wherein said playing step includes selecting a message based on the time of day of selecting the message.

19. A method according to claim 17 wherein said playing step includes selecting a message based on the day of the week in which the message is selected.

20. A method according to claim 15 wherein said playing step includes selecting a message based on the floor of the building on which said message is to be played.

21. A method according to claim 14 further comprising the step of:

at a predetermined point in time related to the car arriving at said one floor, recording an indication of the fact that said message has completed playing, if it has, or alternatively, turning off said message.

22. A method according to claim 14 wherein said playing step comprises:

providing a plurality of threshold signals, each of said messages corresponding to one of said threshold signals, each one of said threshold signals indicative of the fact that a message corresponding thereto has a duration equal to or less than a duration corresponding to said one threshold signal;

comparing the time indicated by said time signal with the durations indicated by said threshold signals and identifying the threshold signal having the largest corresponding duration which is less than or equal to said time signal; and playing in said elevator corridor one of said messages that corresponds to said threshold signal.

23. A method according to claim 22 wherein each of said threshold signals has a plurality of messages corresponding thereto and said playing step includes selecting one message from among the plurality associated with one of said threshold signals.

24. A method according to claim 14 further comprising:

upon completion of playing said one message, repeating said estimating step, said comparing step and said playing step.

25. A method according to claim 14 wherein said playing step includes playing each of said messages no more than once during the time for a car to respond to each request.

26. A method of selecting and playing messages in a shuttle system for conveying passengers in which a call to a landing is initiated by activating a landing call button, and having a controller for causing cars to respond to such requests, including providing access to cars through a landing door in a shuttle corridor, comprising:

providing a plurality of predetermined messages, at least one of said messages having a duration different from at least another of said messages;

estimating the time remaining before the shuttle system will provide access to passengers to be served through said landing door;

selecting, from said plurality of messages, a message having a duration less than said estimated remaining time; and playing the selected message in the vicinity of and within the perception of said passengers to be served in said shuttle corridor while said landing call registered for said landing is unanswered.

* * * * *